US008965557B2

(12) United States Patent
Gourraud

(10) Patent No.: US 8,965,557 B2
(45) Date of Patent: Feb. 24, 2015

(54) METHOD FOR MACHINING A SURFACE OF AN OPTICAL LENS

(75) Inventor: Alexandre Gourraud, Charenton le Pont (FR)

(73) Assignee: Essilor International (Compagnie Generale d'Optique), Charenton le Pont (FR)

( * ) Notice: Subject to any disclaimer, the term of this patent is extended or adjusted under 35 U.S.C. 154(b) by 512 days.

(21) Appl. No.: 13/378,664

(22) PCT Filed: May 20, 2010

(86) PCT No.: PCT/EP2010/057012

§ 371 (c)(1), (2), (4) Date: Dec. 15, 2011

(87) PCT Pub. No.: WO2010/145912

PCT Pub. Date: Dec. 23, 2010

(65) Prior Publication Data

US 2012/0094577 A1 Apr. 19, 2012

(30) Foreign Application Priority Data

Jun. 15, 2009 (EP) ..... 09305541

(51) Int. Cl.

| | |
|---|---|
| ***G06F 19/00*** | (2011.01) |
| ***B24B 1/00*** | (2006.01) |
| ***B24B 7/30*** | (2006.01) |
| ***B24B 7/00*** | (2006.01) |

(Continued)

(52) U.S. Cl.

CPC ..... *B24B 13/0012* (2013.01); *B24B 13/06* (2013.01)

USPC ..... 700/174; 700/160; 451/42; 451/123; 351/159.42

(58) Field of Classification Search

CPC .... B24B 13/02; B24B 13/0012; B24B 13/06; B24B 1/00; B24B 51/00; B24B 9/148; G02C 13/003; G02C 7/083; G02C 7/061; G02C 7/063; G02C 2202/06; G02C 2202/20; G05B 13/024; G05B 19/19; G05B 19/404; G05B 2219/45175; G05B 2219/49354; A61F 2/1613

USPC ..... 700/117, 159, 160, 175, 174; 451/28, 451/41, 42, 119–121, 123; 351/41, 159.01, 351/159.41, 159.42

See application file for complete search history.

(56) References Cited

U.S. PATENT DOCUMENTS

| | | | | |
|---|---|---|---|---|
| 3,889,426 | A * | 6/1975 | Blum | 451/159 |
| 3,900,971 | A * | 8/1975 | Brueck | 451/239 |
| 4,063,390 | A * | 12/1977 | Chevalier | 451/42 |
| 4,216,626 | A * | 8/1980 | Starp | 451/163 |
| 4,392,331 | A * | 7/1983 | Schimitzek et al. | 451/159 |
| 5,096,281 | A | 3/1992 | Windebank et al. | |
| 6,813,536 | B1 * | 11/2004 | Gottschald | 700/160 |
| 7,111,938 | B2 * | 9/2006 | Andino et al. | 351/212 |
| 7,604,349 | B2 * | 10/2009 | Blum et al. | 351/159.42 |

(Continued)

FOREIGN PATENT DOCUMENTS

| | | |
|---|---|---|
| EP | 1 964 630 | 9/2008 |
| EP | 2724815 A1 * | 4/2014 |
| GB | 2 452 091 | 2/2009 |

*Primary Examiner* — Crystal J Barnes-Bullock

(74) *Attorney, Agent, or Firm* — Cozen O'Connor

(57) ABSTRACT

Method for determining movement data representing the movement of a machining tool of an optical lens 3D machining device for machining a surface of an optical lens, wherein the method comprises: a machining tool data providing stage, a surface data providing stage, a machining rule providing stage, a 3D surface determining stage in which the 3D surface corresponding to the surface consisting of all the positions of the reference point of the machining tool that allow the profile of the cutting edge of the machining tool to tangent the derivable surface of the optical lens is determined, a movement data determining stage.

11 Claims, 3 Drawing Sheets

(51) Int. Cl.

| | |
|---|---|
| ***B24B 9/00*** | (2006.01) |
| ***G02C 7/00*** | (2006.01) |
| ***G02C 7/02*** | (2006.01) |
| ***G02C 7/06*** | (2006.01) |
| ***B24B 13/00*** | (2006.01) |
| ***B24B 13/06*** | (2006.01) |

(56) References Cited

U.S. PATENT DOCUMENTS

| | | | | |
|---|---|---|---|---|
| 7,656,509 | B2 * | 2/2010 | Haddock et al. | 356/4.07 |
| 7,728,949 | B2 * | 6/2010 | Clarke et al. | 349/201 |
| 8,118,642 | B2 * | 2/2012 | Coulon et al. | 451/7 |
| 2014/0039665 | A1 * | 2/2014 | Schneider et al. | 700/159 |

* cited by examiner

METHOD FOR MACHINING A SURFACE OF AN OPTICAL LENS

RELATED APPLICATIONS

This is a U.S. National Phase Application under 35 USC 371 of International Application PCT/EP2010/057012 filed on May 20, 2010.

This application claims the priority of European application no. 09305541.6 filed Jun. 15, 2009, the entire content of which is hereby incorporated by reference.

BACKGROUND OF THE INVENTION

The invention relates to a method for determining movement data representing the movement of a machining tool of an optical lens 3D machining device for machining a surface of an optical lens.

The fabrication of an ophthalmic lens generally includes a first phase during which a blank is produced by molding and/or machining having an edge delimited by a front face and a rear face, and a second phase during which the blank is trimmed, i.e. the edge of the ophthalmic lens is machined to change it to a shape adapted for insertion in a given eyeglass frame.

During the first phase, correction properties corresponding to the prescription of the future wearer are conferred on the ophthalmic lens by the shape and the relative dispositions of the front and rear faces (the rear face being that which is turned towards the eye of the wearer of the correcting eyeglasses).

Some ophthalmic lenses, in particular so-called "progressive" lenses for correcting presbyopia, have a front face or a rear face that is asymmetrical with respect to the longitudinal axis of the cylinder formed by the edge of the untrimmed lens.

If a face of the lens is symmetrical with respect to that longitudinal axis, that face can be machined on the blank by making use of a standard turning process, the blank being driven in rotation about a rotation axis while a machining tool comes into contact with the lens to machine that symmetrical face.

On the other hand, if an asymmetrical face must be produced, the standard turning processes can no longer be employed in that they enable the machining only of shapes that are symmetrical with respect to the rotation axis of the part.

One solution for machining asymmetrical surfaces consists in making use of a method of machining a face of an ophthalmic lens including a machining stage during which the position of the machining tool is synchronized with the angular position of the ophthalmic lens driven in rotation about a rotation axis transverse to the face, so as to machine on the face a surface that is asymmetrical with respect to the rotation axis of the ophthalmic lens.

FIGS. 1 and 2 show the shape of a progressive ophthalmic lens 1. The view from above in FIG. 2 shows that this lens 1 has a circular contour. That circular contour is machined to correspond to the contour of a chosen spectacle frame.

FIG. 1 shows a typical profile of a progressive ophthalmic lens 1. The progressive ophthalmic lens 1 has a rear face 2 the curvature whereof is regular and a front face 3 the curvature whereof is greatly accentuated in a particular area of the progressive ophthalmic lens 1.

The progressive ophthalmic lens 1 therefore does not exhibit rotational symmetry with respect to the longitudinal axis 4 passing through the center of the circular contour of the progressive ophthalmic lens 1.

As illustrated on FIG. 3 an optical lens 1 is driven in rotation in the direction C about a rotation axis 10. A machining tool 14 mobile about a parallel translation axis 11 and a perpendicular translation axis 12 is driven in contact with the surface of the optical lens 1 to be machined.

The perpendicular axis 12 is the axis perpendicular to the rotation axis 10 defining with the rotation axis 10 a plan comprising the cutting edge 35 of the machining tool 14.

A turning device 16 is adapted to drive the optical lens 5 in rotation in the direction C. The position of the machining tool 14 at least along the parallel translation axis 11 is synchronized with the rotation.

The movement of the machining tool is usually determined according to the desired surface of the ophthalmic lens. Machining the surface of an ophthalmic lens according to such movement requires that the frequency of reversal of the translation movement of the machining tool 14 along the parallel axis be greater than the rotation frequency of the rotation axis.

Depending on the topology of the front face of the ophthalmic lens, it may be required that the frequency of reversal of the translation movement of the machining tool 14 along the perpendicular axis 12 be greater than the rotation frequency of the rotation axis.

For example, the machining of an asymmetric optical lens comprising a series of Fresnel zones requires that the frequency of reversal of the translation movement of the machining tool 14 along the perpendicular axis 12 be greater than the rotation frequency of the rotation axis.

Therefore, as explained above the machining of such optical lens requires the use of 3D machining devices having the frequency of reversal of the translation movement of the machining tool 14 along the parallel axis 11 and the perpendicular axis 12 be greater than the rotation frequency of the rotation axis.

Such 3D machining devices are very expensive and not very effective.

SUMMARY OF THE INVENTION

One object of the invention is to provide a method for determining movement data representing the movement of a machining tool of an optical lens 3D machining device for machining an optical lens that does not present the drawbacks mentioned hereinabove.

To this end, one aspect of the invention is directed to a method of determining movement data representing the movement of a machining tool of an optical lens 3D machining device for machining a surface of an optical lens, wherein the optical lens 3D machining device comprises at least a rotation axis, a parallel translation axis parallel to the rotation axis and a perpendicular translation axis perpendicular to the rotation axis, and wherein the method comprises:

1) a machining tool data providing stage in which tool data representing the profile of the cutting edge of the machining tool and the position of a reference point of the machining tool relative to the cutting edge are provided,
2) a surface data providing stage in which surface data representing the derivable surface of the optical lens are provided,
3) a machining rule providing stage in which rule data representing machining rules are provided,
4) a 3D surface determining stage in which the 3D surface corresponding to the surface consisting of all the positions of the reference point of the machining tool that allow the profile of the cutting edge of the machining tool to tangent the derivable surface of the optical lens is determined, 5) a movement data determining stage in which movement data representing the movement of the reference point of the machining tool so as to machine the surface of the optical lens are determined in different plans perpendicular to the axis of rotation of the optical lens 3D machining device, the distances between the different plans are determined according to the machining rules.

Advantageously, a method according to an embodiment of the invention provides movement data that may be used to machine a optical lens using a 3D machining device having a rotation axis, a perpendicular translation axis perpendicular to the rotation axis and a parallel translation axis parallel to the rotation axis wherein the frequency of reversal of the translation movement of the machining tool along the parallel translation axis is smaller than or equal to the rotation frequency of the rotation axis.

According to further embodiments which can be considered alone or in combination:

the machining rules provide that the distance between two consecutive plans along the axis of rotation is chosen so as to have the maximum distance between the curves corresponding to the intersection of the two consecutive plans and the 3D surface smaller than or equal to 10% of the value of the characteristic distance of the machining tool;

the rotation axis corresponds to a rotation axis of the optical lens;

the parallel and perpendicular translation axes correspond to axes of translation of the machining tool;

machining rules provide that the distance between two consecutive plans along the rotation axis is chosen so as to have the maximum peak to valley value of the residual profile substantially equal to a desired value;

the optical lens is a progressive addition lens;

the optical lens comprises a Fresnel surface having a series of Fresnel zones and the method further comprises prior to the surface data providing stage a flattening stage in which a derivable surface having the same optical function as the Fresnel surface is determined;

the optical lens is a progressive addition lens and the series of Fresnel zones are located at least in the progressive addition zones; the Fresnel zones are neither coaxial rings nor ellipses; and the machining rules provide that the distances between the different plans along the axis of rotation are chosen so as to correspond to the average or maximum or minimum distance between two successive Fresnel zones.

According to another aspect, the invention relates to a method for machining a surface of an optical lens, the method comprises:

a 3D machining device providing stage in which an optical lens 3D machining device comprising at least a rotation axis, a parallel translation axis parallel to the rotation axis and a perpendicular translation axis perpendicular to the rotation axis is provided, and a machining stage in which the surface of the optical lens is machined by driving in rotation about the rotation axis the optical lens and having a machining tool of the optical lens 3D machining device move according to movement data determined using a method according to the invention.

According to further embodiments which can be considered alone or in combination:

the frequency of reversal of the translation movement of the machining tool along the parallel axis is smaller than or equal to the rotation frequency of the rotation axis;

the frequency of reversal of translation of the machining tool along the perpendicular axis is greater than the frequency of the rotation axis.

According to another aspect, the invention relates to a computer program product comprising one or more stored sequence of instruction that is accessible to a processor and which, when executed by the processor, causes the processor to carry out at least one, for example all, of the stages of at least one of the methods according to the invention.

Another aspect of the invention relates to a computer readable medium carrying one or more sequences of instructions of the computer program according to the invention.

Unless specifically stated otherwise, as apparent from the following discussions, it is appreciated that throughout the specification discussions utilizing terms such as "computing", "calculating", "generating", or the like, refer to the action and/or processes of a computer or computing system, or similar electronic computing device, that manipulate and/or transform data represented as physical, such as electronic, quantities within the computing system's registers and/or memories into other data similarly represented as physical quantities within the computing system's memories, registers or other such information storage, transmission or display devices. Embodiments of the present invention may include apparatuses for performing the operations herein. This apparatus may be specially constructed for the desired purposes, or it may comprise a general purpose computer or Digital Signal Processor ("DSP") selectively activated or reconfigured by a computer program stored in the computer. Such a computer program may be stored in a computer readable storage medium, such as, but is not limited to, any type of disk including floppy disks, optical disks, CD-ROMs, magnetic-optical disks, read-only memories (ROMs), random access memories (RAMs) electrically programmable read-only memories (EPROMs), electrically erasable and programmable read only memories (EEPROMs), magnetic or optical cards, or any other type of media suitable for storing electronic instructions, and capable of being coupled to a computer system bus.

The processes and displays presented herein are not inherently related to any particular computer or other apparatus. Various general purpose systems may be used with programs in accordance with the teachings herein, or it may prove convenient to construct a more specialized apparatus to perform the desired method. The desired structure for a variety of these systems will appear from the description below. In addition, embodiments of the present invention are not described with reference to any particular programming language. It will be appreciated that a variety of programming languages may be used to implement the teachings of the inventions as described herein.

BRIEF DESCRIPTION OF THE DRAWINGS

Non limiting embodiments of the invention will now be described with reference to the accompanying drawing wherein.

DETAILED DESCRIPTION OF THE DRAWINGS

Elements in the figures are illustrated for simplicity and clarity and have not necessarily been drawn to scale. For example, the dimensions of some of the elements in the figure may be exaggerated relative to other elements to help improve the understanding of the embodiments of the present invention.

In the sense of the invention, a "3D machining device for machining an optical lens" corresponds to any machining device adapted to machine 3D surfaces of optical lenses known from the person skilled in the art. An example of such 3D machining device, is given in US 2008/0190254. Such 3D machining device comprises at least a rotation axis, a parallel translation axis parallel to the rotation axis and a perpendicular translation axis perpendicular to the rotation axis.

The rotation axis is arranged to drive in rotation an optical lens to be machined. The parallel and perpendicular translation axis are arranged to drive in translation a machining tool in a direction parallel and respectively perpendicular to the rotation axis.

Figure 1:
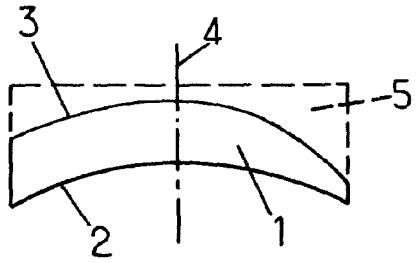
FIGS. 1 and 2 represent a progressive ophthalmic lens, seen respectively in profile and from above.
Figure 2:
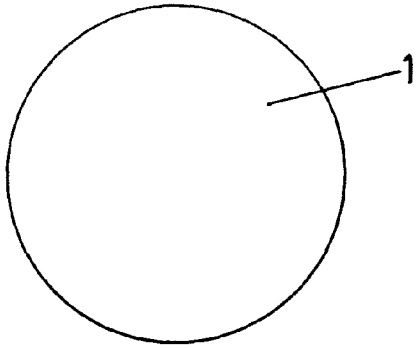
Figure 3:
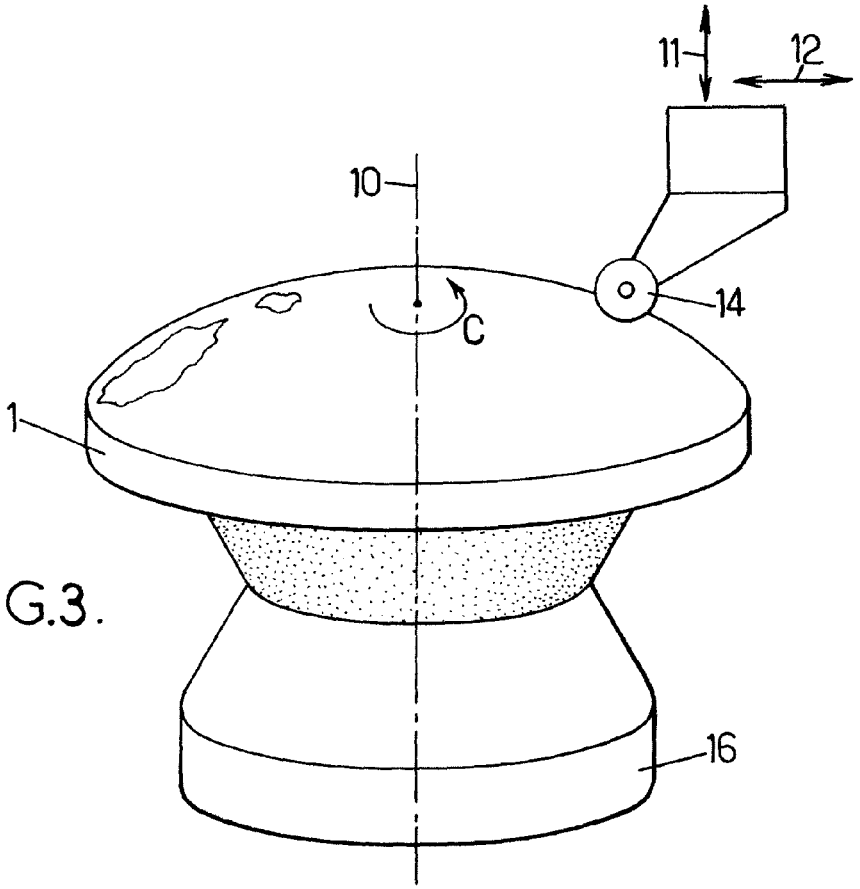
FIG. 3 represents a schematic representation of a perspective view of a 3D machining device that may be used to machine an optical lens according to the invention.
Figure 4:
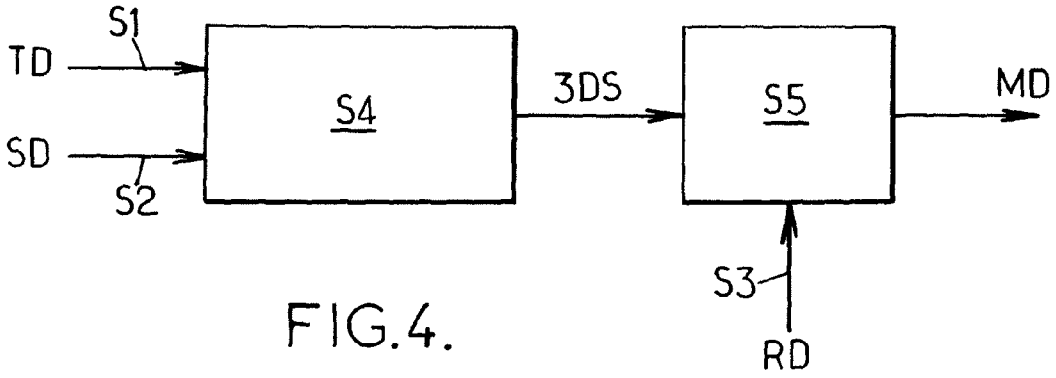
FIG. 4 is a representation of the different stages of a method according to the invention.

According to an embodiment of the invention illustrated on FIG. 4, the method for determining movement data representing the movement of a machining tool of an optical lens 3D machining device for machining a surface of an optical lens according to the invention comprises:

1) a machining tool data providing stage S1,
2) a surface data providing stage S2,
3) a machining rule providing stage S3,
4) a 3D surface determining stage S4, and
5) a movement data determining stage S5.

During the machining tool data providing stage S1, tool data TD representing the profile of the cutting edge of the machining tool and the position of a reference point of the machining tool relative to the cutting edge are provided.

Figure 5A:
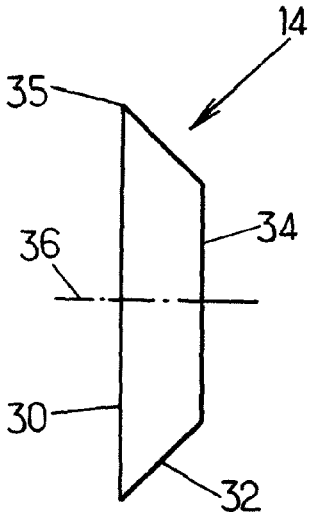
FIGS. 5*a* and 5*b* represent machining tools seen respectively in profile and face-on, FIG. 6 represents a working mode of the tool from FIGS. 5*a* and 5*b* in nominal mode.
Figure 5B:
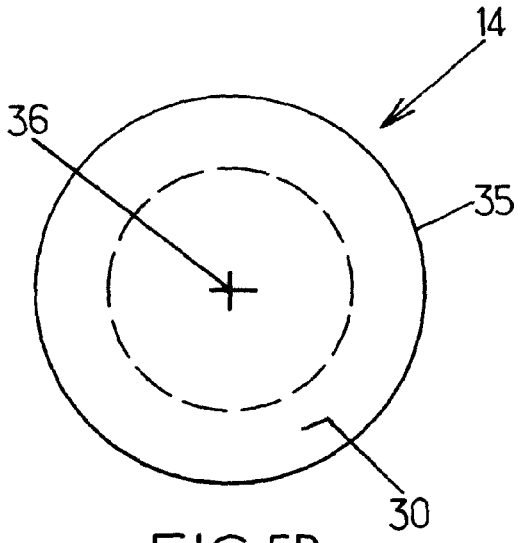

An example of a machining tool is represented on FIGS. 5*a* and 5*b*, respectively in profile and face-on.

The machining tool 14 has a circular shape and features a working face 30 forming a cutting edge with a lateral bevel 32 linking the working face 30 to a rear face 34 having a smaller diameter than the working face.

The tool 14 may be held in a tool-carrier (not shown) by a screw fixing the center 36 of the tool 14 to the tool-carrier, or by any means enabling rigid connection of the tool 14 to the tool-carrier so that the cutting edge is accessible over at least a portion of the circumference of the tool 14 for machining the surface of an optical lens.

The tool 14 can be made of polycrystalline diamond, monocrystalline diamond, or any other material suitable for the production of a turning tool.

Figure 6:
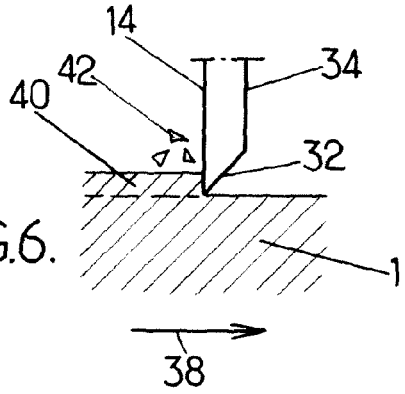

FIG. 6 shows a turning tool 14 in a so-called "nominal" cutting configuration. In the nominal cutting configuration, the surface of an optical lens to be machined is driven in rotation in the direction 38 and the tool 14 is positioned so that the cutting edge attacks a layer 40 to be removed and the working face 30 producing chips 42. This configuration is that for which this kind of tool 14 is designed.

According to an embodiment of the invention, the profile of the cutting edge 35 of the machining tool 14 corresponds to the external profile of the working face 30, represented by a solid line on FIG. 5*b*.

According to an embodiment of the invention, the reference point of the machining tool 14 may be the center 36 of the tool 14.

During the surface data providing stage S2, surface data SD representing the derivable surface of the optical lens are provided.

According to an embodiment of the invention, the surface data SD represent the derivable surface of the optical lens to be machining. In the sense of the invention a surface is derivable when it is possible at each point of the surface to define a tangent to the surface.

Some optical lens surfaces may be non-derivable, for example optical lenses comprising a series of Fresnel zones.

Methods for providing a derivable surface having the same optical function as a non-derivable surface are well known from the person skilled in the art. For example, such method may comprise determining a transfer function between the derivable surface and the non-derivable surface. Reciprocally, methods for providing a non-derivable surface having the same optical function as a derivable surface are well known from the person skilled in the art.

According to an embodiment of the invention, if the surface to be machined is non-derivable the method according to the invention further comprises a flattening stage, in which a derivable surface having the same optical function as the surface to be machined is determined.

In the sense of the invention, two optical surfaces are considered as having the same optical function when for each point they have the same gradient and/or the same curvature.

In the sense of the invention, two optical surfaces having the same average power distribution may be considered as having the same optical function.

According to an embodiment of the invention represented on FIG. 4, the tool data TD and the surface data SD are processed during the 3D surface determining stage S4 in which the 3D surface 3DS corresponding to the surface consisting of all the positions of the reference point of the machining tool that allow the profile of the cutting edge of the machining tool to tangent the derivable surface of the optical lens is determined.

In the sense of the invention, the profile of the cutting edge 35 is considered tangent to a point of the derivable surface of the optical lens when, in the projection plan comprising the perpendicular 11 and parallel 12 axis, the normal direction of the profile of the cutting edge 35 at that point corresponds to the normal direction of the derivable surface at that point.

Figure 7:
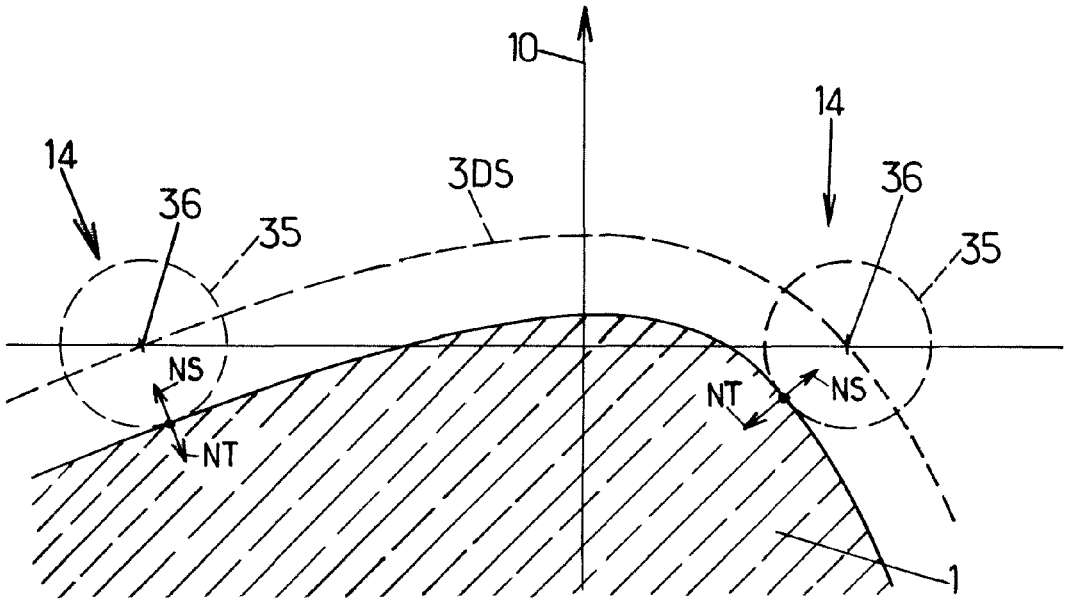
FIG. 7 represents the derivable surface of an ophthalmic lens with the 3D surface determination in profile.

FIG. 7 represents an ophthalmic lens 1 being machined in profile in the projection plan comprising the perpendicular 11 and parallel 12 axis.

The machining tool 14 has been represented in two positions where the profile of the cutting edge 35 is tangent to the derivable surface of the ophthalmic lens 1. As represented on FIG. 7, the normal NT to the machining tool is colinear to the normal NS to the derivable surface of the ophthalmic lens 1.

As illustrated on FIG. 7, the 3D surface 3DS corresponds to the surface consisting of all the positions of the reference point 36 of the machining tool that allow the profile 35 of the cutting edge to tangent the derivable surface of the optical lens 1.

According to the embodiment of the invention represented on FIG. 4, further to the 3D surface determining stage S4, the method comprises a machining rule providing stage S3 in which rule data RD representing machining rules are provided.

According to an embodiment of the invention the rule data RD may be provided together with the surface data SD.

The rule data RD are used to process the 3D surface 3DS during the movement data determining stage S5 in which movement data MD representing the movement of the reference point of the machining tool so as to machine the surface of the optical lens are determined. The movement data MD are determined in different plans perpendicular to the axis of rotation of the optical lens 3D machining device. The movement data MD further comprise the movement of the reference point of the machining tool between the different plans. According to an embodiment of the invention, the reference point of the machining tool moves along the 3D surface between two consecutive plans.

The distances between the different plans are determined according to the machining rules comprised in the rule data RD.

Advantageously, the method according to the invention allows using a 3D machining device having a parallel axis arranged so as to have the frequency of reversal of the translation movement of the machining tool along the parallel axis smaller than or equal to the rotation frequency of the rotation axis.

Indeed, in the method according to the invention, the movement of the machining tool in each plan is determined so as to have the reference point of the machining tool move in that plan.

Therefore, the frequency of reversal of the translation movement of the machining tool along the parallel axis may be smaller than the rotation frequency of the rotation axis.

Whereas, according to prior art methods the movement of the machining tool 14 is determined by considering the surface of the optical lens to be machined and determining the movement of the cutting edge of the machining tool 14 along a spiral which can be locally be considered as a succession of concentric circles on the surface to be machined.

When the machining tool moves according to such movement the center of the machining tool is not maintained in a plan perpendicular to the rotation axis of the machining device. Therefore, when machining a asymmetrical surface of an optical lens using such prior art methods it is required that the frequency of reversal of the translation movement of the machining tool 14 along the parallel axis 11 be greater than the rotation frequency of the rotation axis 10.

According to an embodiment of the invention, the machining rules MR provide that the distance between two consecutive plans along the rotation axis 10 is chosen so as to have the maximum distance between the curves corresponding to the intersection of the two consecutive plans and the 3D surface smaller than or equal to 10% of the value of a characteristic distance of the machining tool.

According to an embodiment of the invention, the characteristic distance of the machining tool may be the average radius of the machining tool. The average radius of the machining tool may be of 2 mm. Therefore, the distance between two consecutive plans may be smaller than or equal to 0.2 mm.

Advantageously, such machining rules allow minimizing the stress on the machining tool during a machining stage.

According to an embodiment of the invention, the machining rule MR provide that the distance between two consecutive plans along the rotation axis is chosen so as to have the maximum peak to valley value of the residual surface substantially equal to a desired value.

In the sense of the invention, the residual surface is the surface corresponding to the difference between the desired surface and the machined surface. Depending on the surface quality expected after machining a maximum pick to valley value may be determined. For example, the maximum pick to valley value may be of 3 μm.

Advantageously, such machining rules MR allow controlling the quality surface of the machined optical surface.

According to an embodiment of the invention, the optical lens may comprise a non-derivable surface such as a Fresnel surface having a series of Fresnel zones. The method further comprises prior to the surface data providing stage a flattening stage, in which a derivable surface having the same optical function as the Fresnel surface is determined.

The machining of an asymmetric optical lens comprising a non-derivable surface such as a Fresnel surface requires the use of a 3D machining device wherein the frequency of reversal of translation of the machining tool along the perpendicular axis is greater than the frequency of the rotation axis.

Advantageously, using the movement data MD determined by a method according to the invention allows using a 3D machining device wherein the frequency of reversal of translation of the machining tool along the parallel axis is smaller than the frequency of the rotation axis.

According to an embodiment of the invention wherein the optical lens comprises a Fresnel surface having a series of Fresnel zones, the machining rules provide that at least part of the different plans are Fresnel plans. In the sense of the invention, Fresnel plans are plans along the axis of rotation defined so that the intersections of those Fresnel plans with the 3D surface describe curves which correspond to the projection following the axis of rotation of the limits of the Fresnel zones. The distances between the different plans, in particular between the Fresnel plans, along the axis of rotation are chosen so as to correspond to the average or maximum or minimum distance between two successive Fresnel zones.

According to an embodiment of the invention, the machining rules (MR) provide that the distances between the different Fresnel plans along the axis of rotation are chosen so as to have the average or maximum or minimum distance between the curves corresponding to the intersection of the two consecutive plans and the 3D surface which correspond to respectively the average or maximum or minimum distance between two successive Fresnel zones.

Accordingly, the machining rules comprise a transfer function to be applied to the 3D surface so as to machine the Fresnel surface.

The invention has been described above with the aid of embodiments without limitation of the general inventive concept.

The invention claimed is:

1. A method for machining a surface of an optical lens, comprising:

providing a 3D machining device, the optical lens 3D machining device comprising a rotation axis, a parallel translation axis parallel to the rotation axis, a perpendicular translation axis perpendicular to the rotation axis, and a machining tool; and machining the surface of the optical lens by driving in rotation about the rotation axis the optical lens and having the machining tool of the optical lens 3D machining device move according to movement data determined using a method comprising:

1) providing a machining tool data providing stage in which tool data representing the profile of the cutting edge of the machining tool and the position of a reference point of the machining tool relative to the cutting edge;

2) providing a surface data providing stage in which surface data representing the derivable surface of the optical lens;

3) providing a machining rule providing stage in which rule data representing machining rules;

4) providing a 3D surface determining stage in which the 3D surface corresponding to the surface consisting of all the positions of the reference point of the machining tool that allow the profile of the cutting edge of the machining tool to tangent the derivable surface of the optical lens is determined; and 5) providing a movement data determining stage in which movement data representing the movement of the reference point of the machining tool so as to machine the surface of the optical lens are determined in different plans perpendicular to the axis of rotation of the optical lens 3D machining device, the distances between the different plans are determined according to the machining rule, wherein a frequency of reversal of translation movement of the machining tool along the parallel axis is smaller than or equal to a rotation frequency of the rotation axis.

2. The method according to claim 1, wherein the machining rules provide that the distance between two consecutive plans along the axis of rotation is chosen so as to have the maximum distance between the curves corresponding to the intersection of the two consecutive plans and the 3D surface smaller than or equal to 10% of the value of the characteristic distance of the machining tool.

3. The method according to claim 1, wherein machining rules provide that the distance between two consecutive plans along the rotation axis is chosen so as to have the maximum peak to valley value of the residual profile substantially equal to a desired value.

4. The method according to claim 1, wherein the optical lens is a progressive addition lens.

5. The method according to claim 1, wherein the optical lens comprises a Fresnel surface having a series of Fresnel zones and the method further comprises prior to the surface data providing stage a flattening stage in which a derivable surface having the same optical function as the Fresnel surface is determined.

6. The method according to claim 5, wherein the optical lens is a progressive addition lens and the series of Fresnel zones are located at least in the progressive addition zones.

7. The method according to claim 5, wherein the Fresnel zones are neither coaxial rings nor ellipses.

8. The method according to claim 5, wherein the machining rules provide that the distances between the different plans along the axis of rotation are chosen so as to correspond to the average or maximum or minimum distance between two successive Fresnel zones.

9. The method according to claim 1, wherein the frequency of reversal of translation of the machining tool along the perpendicular axis is greater than the frequency of the rotation axis.

10. A computer program product comprising stored sequences of instructions that are accessible to a computer and which sequences of instructions, when executed by the computer, causes the computer to use a method comprising:

1) providing a machining tool data providing stage in which tool data representing the profile of the cutting edge of the machining tool and the position of a reference point of the machining tool relative to the cutting edge;

2) providing a surface data providing stage in which surface data representing the derivable surface of the optical lens;

3) providing a machining rule providing stage in which rule data representing machining rules;

4) providing a 3D surface determining stage in which the 3D surface corresponding to the surface consisting of all the positions of the reference point of the machining tool that allow the profile of the cutting edge of the machining tool to tangent the derivable surface of the optical lens is determined;

5) providing a movement data determining stage in which movement data representing the movement of the reference point of the machining tool so as to machine the surface of the optical lens are determined in different plans perpendicular to the axis of rotation of the optical lens 3D machining device, the distances between the different plans are determined according to the machining rules; and 6) causing a 3D machining device, comprising a rotation axis, a parallel translation axis parallel to the rotation axis, a perpendicular translation axis perpendicular to the rotation axis, and a machining tool, to machine a surface of an optical lens by driving in rotation about the rotation axis the optical lens and to move according to movement data determined in the movement data determining stage, wherein a frequency of reversal of translation movement of the machining tool along the parallel axis is smaller than or equal to a rotation frequency of the rotation axis.

11. A computer readable medium carrying sequences of instructions which, when executed by the computer, causes the computer to use a method comprising:

1) providing a machining tool data providing stage in which tool data representing the profile of the cutting edge of the machining tool and the position of a reference point of the machining tool relative to the cutting edge;

2) providing a surface data providing stage in which surface data representing the derivable surface of the optical lens;

3) providing a machining rule providing stage in which rule data representing machining rules;

4) providing a 3D surface determining stage in which the 3D surface corresponding to the surface consisting of all the positions of the reference point of the machining tool that allow the profile of the cutting edge of the machining tool to tangent the derivable surface of the optical lens is determined;

5) a movement data determining stage in which movement data representing the movement of the reference point of the machining tool so as to machine the surface of the optical lens are determined in different plans perpendicular to the axis of rotation of the optical lens 3D machining device, the distances between the different plans are determined according to the machining rules; and 6) causing a 3D machining device, comprising a rotation axis, a parallel translation axis parallel to the rotation axis, a perpendicular translation axis perpendicular to the rotation axis, and a machining tool, to machine a surface of an optical lens by driving in rotation about the rotation axis the optical lens and to move according to movement data determined in the movement data determining stage, wherein a frequency of reversal of translation movement of the machining tool along the parallel axis is smaller than or equal to a rotation frequency of the rotation axis.

* * * * *